US006021856A

United States Patent [19]

Pascale

[11] Patent Number: 6,021,856

[45] Date of Patent: Feb. 8, 2000

[54] BIT RETENTION SYSTEM

[75] Inventor: Jack H. Pascale, Greentown, Pa.

[73] Assignee: Numa Tool Company, Thompson, Conn.

[21] Appl. No.: 09/087,291

[22] Filed: May 29, 1998

[51] Int. Cl.[7] ..... E21B 10/36

[52] U.S. Cl. ..... 175/414; 175/413; 175/415

[58] Field of Search ..... 175/414, 413, 175/415, 320; 407/52, 41, 101, 102, 112, 46, 47

[56] References Cited

U.S. PATENT DOCUMENTS

| | | | |
|---|---|---|---|
| 1,726,049 | 8/1929 | Swift et al. | 175/348 |
| 2,215,494 | 9/1940 | Athy | 175/435 |
| 2,243,319 | 5/1941 | Ross | 175/319 |
| 2,252,912 | 8/1941 | Armentrout . | |
| 2,336,333 | 12/1943 | Zublin | 175/290 |
| 2,949,909 | 8/1960 | Macchioni et al. . | |
| 3,152,654 | 10/1964 | Conover | 175/382 |
| 3,735,820 | 5/1973 | Curington . | |
| 4,083,415 | 4/1978 | Kitat et al. | 173/132 |
| 4,502,734 | 3/1985 | Allan | 299/88 |
| 4,527,641 | 7/1985 | Klemm | 175/92 |
| 4,962,822 | 10/1990 | Pascale . | |
| 5,052,503 | 10/1991 | Lof | 175/258 |
| 5,065,827 | 11/1991 | Meyers . | |
| 5,139,099 | 8/1992 | Hayashi et al. | 175/292 |
| 5,647,447 | 7/1997 | Jones | 175/300 |

FOREIGN PATENT DOCUMENTS

| | | |
|---|---|---|
| 0 286 373 A2 | 4/1988 | European Pat. Off. . |
| WO 87/04487 | 7/1987 | WIPO . |

*Primary Examiner*—Hoang Dang
*Attorney, Agent, or Firm*—Alix, Yale & Ristas, LLP

[57] ABSTRACT

A downhole hammer bit including at least one bit impact head mounted to a vertical guide member by a plurality of retaining ring segments. Opposed surfaces of the bit impact head and the guide member have corresponding circumferential grooves or groove sections that define a channel or channel sections, respectively, for receiving the retaining ring segments. The retaining ring segments are inserted into the respective channel/channel section via a bore that extends from an external surface of the hammer bit. A pin disposed in the bore retains the retaining ring segments in the channel/channel section. The retaining ring segments engage the upper and lower surfaces of the channel/channel sections along an extended arc, reducing the stress and possibility of mechanical failure.

25 Claims, 7 Drawing Sheets

BIT RETENTION SYSTEM

BACKGROUND OF THE INVENTION

This invention relates generally to earth boring percussion drills. More particularly, the invention relates to retention systems for retaining the drill bit of the percussion drill to a guide device.

Conventional percussion drills utilize a variety of drill bits. Some conventional percussion drills utilize a unitary drill bit that is impacted by the hammer. Carbide impact buttons are generally mounted to the work face of the drill bit to provide a cutting surface that has superior hardness and wear resistance. Eventually, wear and damage to the drill bit work face and the impact buttons reduces the efficiency of the drill bit, requiring either replacement or repair of the drill bit.

The method/apparatus that is used to mount the impact buttons to the work face has a large impact on the cost of repairing the drill bit. Mounting methods/apparatus that are designed to facilitate replacement of worn/broken impact buttons reduce the cost of repairing the drill bit. However, such mounting methods/apparatus are generally more prone to failure than mounting methods/apparatus that are designed to "permanently" mount the impact buttons to the work face. Consequently drill bits employing mounting methods/apparatus that are designed to facilitate replacement of the impact buttons generally require repair at more frequent intervals than other drill bits. Although the methods/apparatus for "permanently" mounting impact buttons are less prone to failure, the impact buttons are much more difficult replace.

Some conventional percussive drills utilize a bit impact head that is removably mounted to a guide device. These drills represent a compromise between removably mounting the impact buttons and permanently mounting the impact buttons. The impact buttons for such drills are generally permanently mounted to the bit impact head to reduce the probability of button failure. The bit impact head may be removed from the guide device and sent to a repair facility while a replacement bit impact head is utilized to minimize down-time. Such conventional drill bits often employ a single pin to retain the removable bit impact head to the guide device. Typically, the pin is inserted through a through bore in the guide device and is received within an undercut in the impact head. Since the guide device and the portion of the impact head that is retained within the guide device are generally cylindrical, the pin typically engages the undercut of the impact head at a tangent point. Consequently, such drill bits are frequently subject to failure due to the concentration of stress resulting from such a connection.

SUMMARY OF THE INVENTION

Briefly stated, the invention is a drill bit having a guide member and at least one impact head that are affixed to each other by a segmented retainer ring. The retainer ring segments are inserted into a channel formed by cooperating grooves in the guide member and impact head via an intersecting bore and engage the upper and lower surfaces of the channel along an extended arc.

The invention in one embodiment is implemented in a downhole hammer bit which comprises an elongated guide member having a longitudinally extending skirt. The skirt defines a receptacle having an inner surface defining upper and lower circumferential grooves. At least one bore extends from the outer surface of the skirt and intersects each groove to define an opening into the receptacle. The mounting portion of the bit impact head is disposed within the receptacle. The outer surface of the mounting portion defines upper and lower grooves disposed opposite to the upper and lower grooves of the skirt. When so positioned, the grooves of the skirt and the grooves of the mounting portion define upper and lower circular channels. A plurality of retaining ring segments are positionable in each of the channels through the corresponding bore and opening, forming upper and lower retainer members for retaining the impact head to the guide member. A pin is disposed in each of the upper and lower bores to retain the retainer members in the upper and lower channels.

The impact head is rotatable around a centerline that is radially offset from the axis of the drill bit. When the drill bit is rotated in the drilling direction, the impact head rotates about the centerline to an extended position to produce a hole large enough to admit the overburden casing. When the drill bit is rotated in the opposite direction, the impact head rotates about the centerline to a withdrawn position, facilitating insertion or removal of the impact drill through the overburden casing. The skirt has upper and lower end faces, defining first and second shoulders and the impact head comprises a lower, pilot impact bit and an upper, impact bit sector having longitudinally spaced upper end faces defining first and second shoulders. The shoulders of the impact head engage a corresponding shoulder of the guide member to limit relative rotation therebetween and thereby hold the impact head in either the extended or withdrawn position against the rotation of the drill bit.

In a second embodiment, the guide member includes a mounting portion having an outer surface. The impact head has the form of a bit ring which is disposed around the mounting portion of the guide member. A groove on the inner surface of the bit ring is positioned adjacent a groove on the outer surface of the guide member to form the channel. A bore extends from the outer surface of the bit ring to the channel to provide access for inserting the retainer ring segments.

Alternatively, the inner surface of the bit ring may have one or more groove segments that are disposed oppositely groove segments in the outer surface of the guide member to form one or more channel sections. At least one bore extends from the outer surface of the bit ring to each of the channel sections.

In a third embodiment, a plurality of impact heads are mounted to the face of the guide member. A retention shaft extends axially from each impact head and is received in an opening extending axially from the face of the guide member. At least one groove in the outer surface of the retention shaft cooperates with a groove on the surface of the opening to form the channel. A bore extends from an outer surface of the guide member to each channel to provide access for inserting the retainer ring segments.

In a first variation of this embodiment utilized for overburden drill bits, the openings in the face of the guide member are disposed in the peripheral portion of the guide member face and a shoulder is disposed adjacent each opening. Each of the retention shafts are pivotably mounted within its associated opening such that the impact head is pivotable between an extended position and a retracted position. A first side of the impact head engages the shoulder to hold the impact head in the extended position and a second side of the impact head engages the shoulder to hold the impact head in the retracted position. A bushing may be disposed intermediate at least a part of each retention shaft and the surface of the associated opening to reduce friction and wear.

In a second variation of the embodiment, a shoulder is disposed adjacent each opening. First and second sides of each impact head engage the corresponding shoulder of the guide member to fixedly mount the impact head to the guide member.

It is an object of the invention to provide a new and improved downhole drill bit which facilitates replacement of a worn or broken bit impact head for such downhole drills.

It is also an object of the invention to provide a new and improved downhole drill bit having a connection between a guide member and a bit impact head that is resistant to stress related failure.

It is further an object of the invention to provide a new and improved downhole drill bit having a retainer for mounting a bit impact head to a guide member which is easy to install and requires fewer, less expensive components.

BRIEF DESCRIPTION OF THE DRAWINGS

The present invention may be better understood and its numerous objects and advantages will become apparent to those skilled in the art by reference to the accompanying drawings in which.

DETAILED DESCRIPTION OF THE PREFERRED EMBODIMENT

Figure 1:
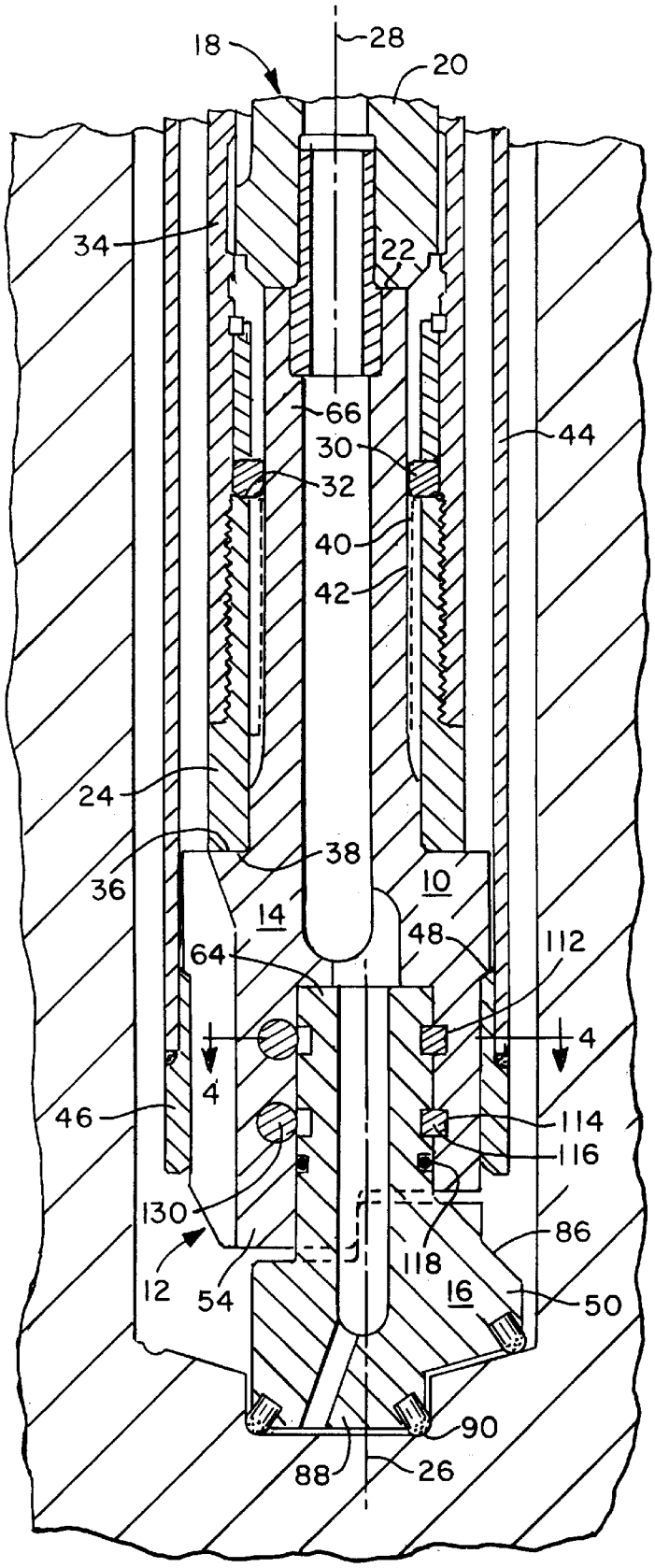
FIG. 1 is a partial longitudinal section view, partly broken away and partly in section, of a downhole impact drill having a first embodiment of a drill bit in accordance with the present invention.

With reference to the drawings wherein like numerals represent like parts throughout the several figures, and particularly to FIG. 1, a pneumatic downhole impact drill 12 is shown which employs a first embodiment of a drill bit 10 in accordance with the present invention. Except as specifically described hereinafter, the downhole impact drill 12 may be similar to that shown and described in U.S. Pat. No. 5,205,363, dated Apr. 27, 1993 and entitled "Porting System For Pneumatic Impact Hammer" (which is incorporated herein by reference). The drill bit 10 includes a rear, elongated guide member 14 and a front, enlarged drill bit impact head 16. The impact head 16 is removably mounted to the guide member 14, as described below, to facilitate replacement of the impact head 16 should it become worn or damaged.

Referring to FIG. 1, the guide member 14 is mounted in the front end of the hammer 18 so than an impact piston 20 of the hammer 18 can be pneumatically reciprocated in a conventional manner to impact a rear anvil end face 22 of the guide member 14 for downhole impact drilling. The impact head 16 is rotatable around a centerline 26 that is radially offset from the axis 28 of the drill bit 10. When the drill bit 10 is rotated in the drilling direction, the impact head 16 rotates about the centerline 26 such that the impact head 16 extends radially beyond the periphery of the overburden casing 44, producing an enlarged hole. When the drill bit 10 is rotated in the opposite direction, the impact head 16 rotates about the centerline 26 such that the impact head 16 the diameter of the drill bit head envelope is substantially less than the diameter of the overburden casing 44, facilitating insertion or removal of the impact drill 12.

In the extended position of the drill bit 10, the guide member 14 is supported, by means of a bit retaining ring 30, on a rear annular end face 32 of the externally threaded chuck 24 which is screwed into the front end of the hammer casing 34. In the retracted position of the drill bit 10, a rear shoulder 36 of the impact head 16 and a front annular end face 38 of the chuck 24 are in engagement. Thus, the chuck 24 and the retaining ring 30 together support and retain the drill bit 10 within the hammer 18. The chuck 24 and the guide member 14 have cooperating internal and external splines 40, 42 which assist in coaxially positioning the drill bit 10 within the hammer 18 with the drill bit 10. The drill bit 10 is removed from the hammer 18 by unscrewing the chuck 24 from the hammer casing 34, removing the subassembly comprising the drill bit 10, the chuck 24, and the retaining ring 30, removing the two semi-circular halves of the split retaining ring 30 from the guide member 14 and then removing the drill bit 10 from the chuck 24.

The drill bit 10 is particularly useful in drilling an enlarged hole for an overburden casing 44. In a conventional manner, the overburden casing 44 is fed into the hole during drilling. For that purpose the rear end of a drive shoe 46, which is welded to the front end of the overburden casing 44, is engaged by a shoulder 48 on the guide member 14. The overburden casing 44 is fed into the hole immediately behind the drill bit sector 50 as the impact drill 12 is fed into the drilled hole.

Figure 2:
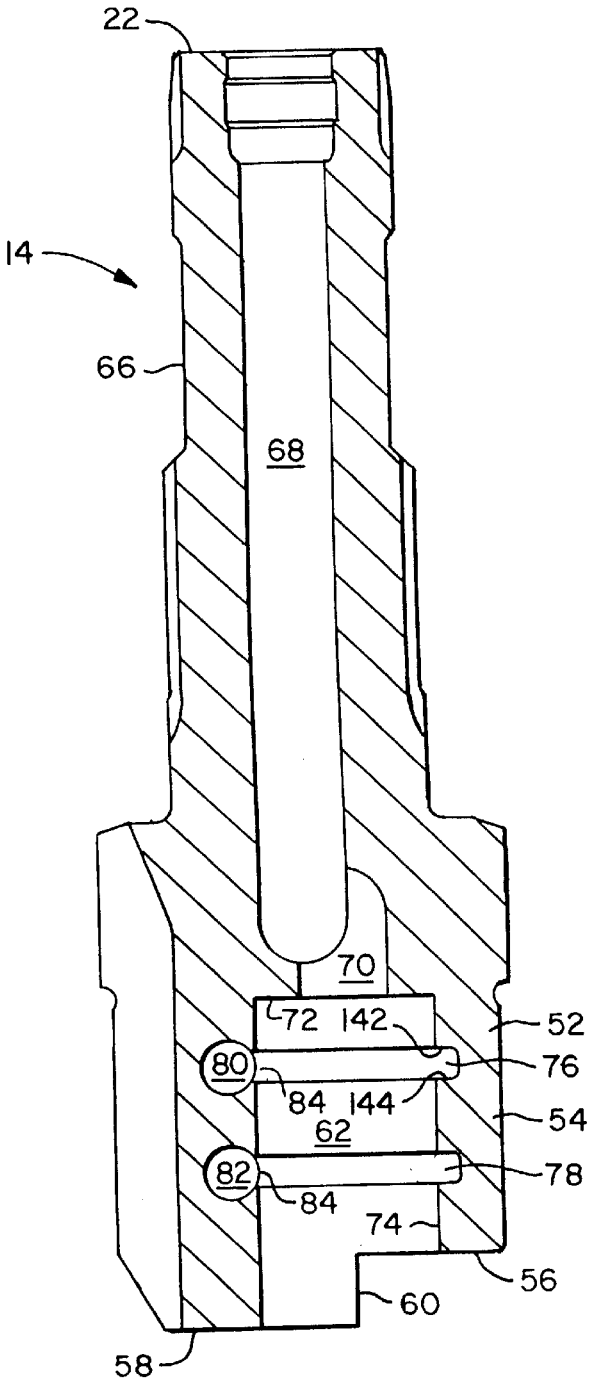
FIG. 2 is an enlarged section view of the guide member of FIG. 1.
Figure 3:
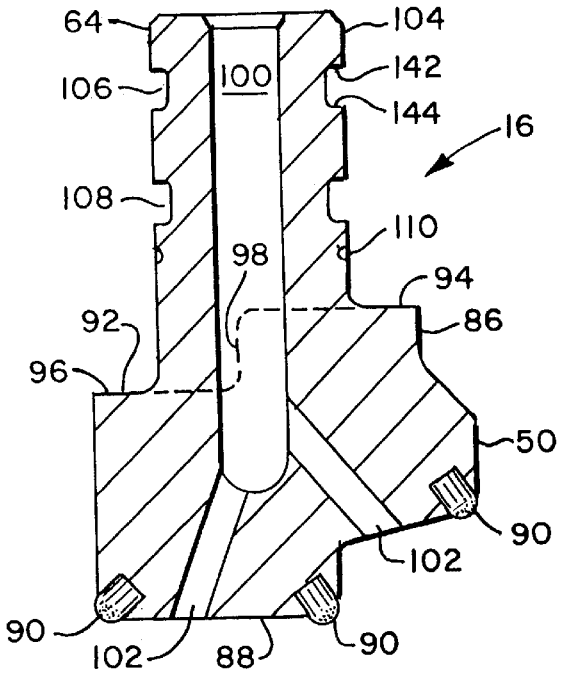
FIG. 3 is an enlarged section view of the impact head of FIG. 1.
Figure 7:
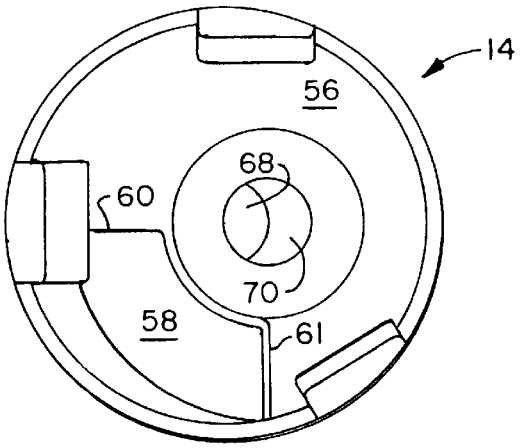
FIG. 7 is an enlarged bottom view of the guide member of FIG. 1.

With reference to FIG. 2, the guide member 14 comprises an impact head mounting segment 52 having a skirt 54 which extends downward to an upper end face 56 and a longitudinally offset lower end face 58, thereby defining first and second shoulders 60, 61 defining an arc substantially equal to 90° (FIG. 7). The skirt 54 forms a receptacle 62 for receiving an upper, mounting portion 64 of the impact head 16 (FIG. 3). A drive shank 66 extends longitudinally upward from the impact head mounting segment 52 to the rear anvil end face 22. An axial, first fluid passage 68 extends through the drive shank 66 and intersects with an axially offset, second fluid passage 70 that extends upward from the upper face 72 of the receptacle 62. The wall 74 of the receptacle 62 includes axially spaced upper and lower circumferential grooves 76, 78. Upper and lower bores 80, 82 extend laterally through the mounting segment 52 from a first position 79 on the skirt outer surface 81 to a second position 83 on the skirt outer surface 81. The bores 80, 82 intersect the upper and lower grooves 76, 78, respectively, such that the area of intersection forms an opening 84 into the receptacle 62. Preferably, the bores 80, 82 are in the same cross-sectional plane as its respective groove 76, 78.

Figure 8:
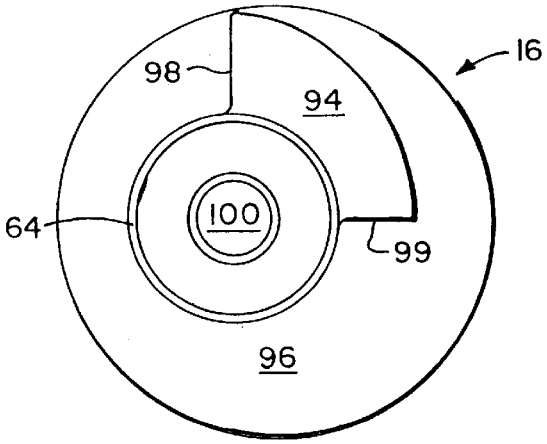
FIG. 8 is an enlarged top view of the impact head of FIG. 1.

With reference to FIG. 3, the impact head 16 includes a lower working portion 86 comprising a leading, pilot bit 88 and a trailing, drill bit sector 50 which is largely located on one side of the bit axis 26. Carbide impact buttons 90 are mounted to the working faces of the pilot bit 88 and drill bit sector 50 of the impact head 16. In the shown embodiment, the body of the drill bit sector 50 is integrally formed with the body of the pilot bit 88. The pilot bit 88 produces a pilot or guide hold for the impact drill 12. The drill bit sector 50 has an outer diameter substantially greater than that of the pilot bit 88. Consequently, trailing drill bit sector 50 produces an enlarged hole as the drill bit 10 is rotated during drilling. With further reference to FIGS. 7 and 8, the upper face of the drill bit sector include an upper end face 92 having upper and lower portions 94, 96 thereby defining first and second shoulders 98, 99 defining an arc substantially equal to 90°.

When the drill bit 10 is rotated in the drilling direction, the impact head 16 rotates about centerline 26 to an extended position to produce an enlarged hole. When the drill bit 10 is rotated in the opposite direction, the impact head 16 rotates approximately 180° about the centerline 26 to a withdrawn position, facilitating insertion or removal of the impact drill 12. The shoulders 98, 99 of the impact head 16 engage a corresponding shoulder 61, 60, respectively, of the guide member 14 to stop relative rotation therebetween and thereby hold the impact head 16 in either the extended or withdrawn position against the rotation of the drill bit 10.

The mounting portion 64 of the impact head 16 has a substantially cylindrical shape, defining a longitudinally extending fluid outlet plenum 100. When the mounting portion 64 is disposed in the receptacle 62, the fluid outlet plenum 100 is disposed oppositely the second passage 70 of the guide member 14, providing fluid communication therebetween. In one preferred embodiment, the working portion 86 of the impact head 16 includes a plurality of longitudinally and laterally extending fluid distribution passages 102 which are in fluid communication with the fluid outlet plenum 100 of the mounting portion 64 of the impact head 16. A flow of pneumatic fluid to the working faces of the pilot bit 88 and drill bit sector 50 of the impact head 16 is provided via the first and second fluid passages 68, 70 of the guide member 14 and the fluid outlet plenum 100 and fluid distribution passages 102 of the impact head 16.

The outer surface 104 of the mounting portion 64 includes upper and lower circumferential grooves 106, 108 and a circumferential notch 110. When the mounting portion 64 is disposed in the receptacle 62, the upper and lower grooves 106, 108 of the mounting portion 64 are disposed oppositely to the upper and lower grooves 76, 78 of the guide member 14, respectively, to define upper and lower circumferential channels 112, 114 (FIG. 1). A retaining member 116 is positioned in each of the channels 112, 114 and thereby retains the impact head 16 to the guide member 14. An O-ring 118 is disposed in the circumferential notch 110 to prevent dirt, cuttings and pneumatic fluid from entering the mating area between the guide member 14 and the impact head 16.

Figure 4:
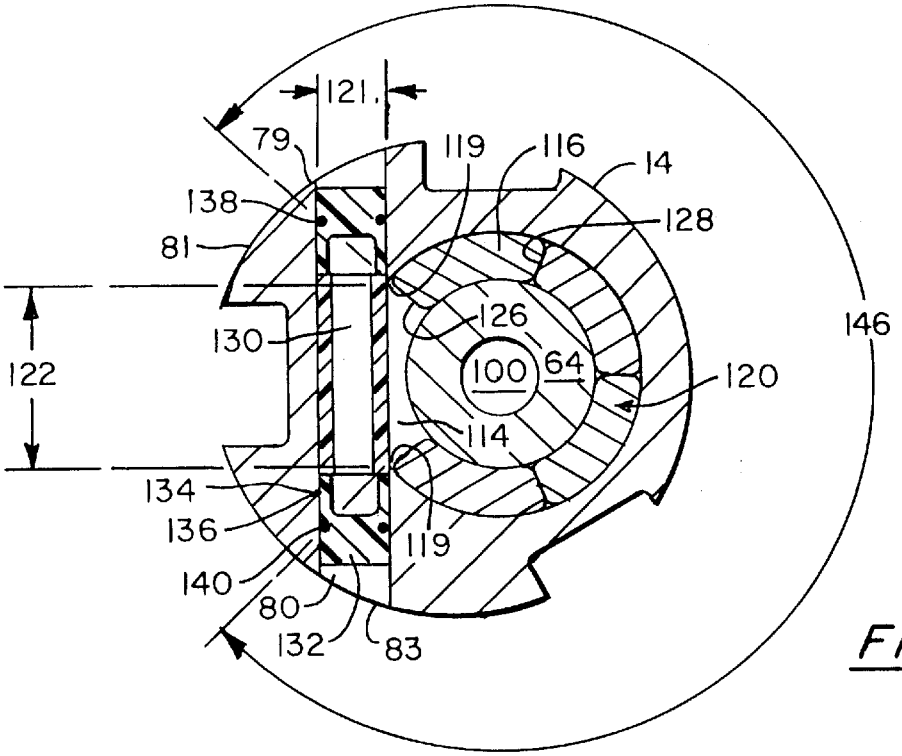
FIG. 4 is an enlarged section view taken along line 4—4 of FIG. 1.
Figure 5:
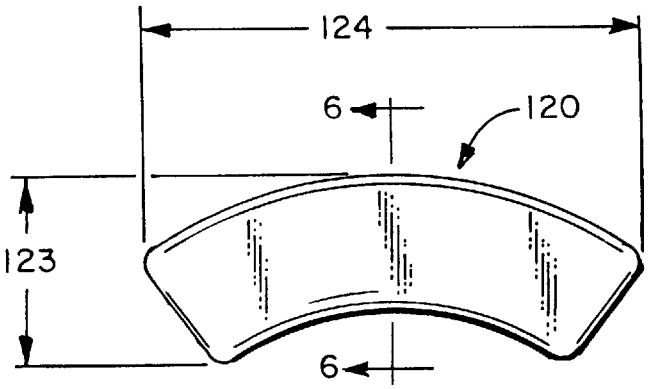
FIG. 5 is an enlarged top view of one of the ring segments of FIG. 1.
Figure 6:
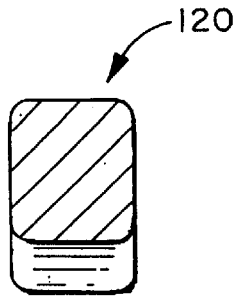
FIG. 6 is a section view taken along line 6—6 of FIG. 5.

In the embodiment shown in FIG. 4, each retaining member 116 comprises four ring segments 120 which are sequentially inserted through a respective upper or lower bore 80, 82. With additional reference to FIG. 5, the diameter 121, 121' of the bores 80, 82, the length 122 of opening 84, the position of the edge 119 of the opening 84 relative to the outer surface 79, 83, the width 123 of the ring segments, and the length 124 of the ring segments 120 are selected such that each ring segment 120 is freely movable in the respective bore 80, 82 and drops into the corresponding channel 112, 114 when it is positioned through the bore 80, 82 and over the opening 84. These factors also determine the ease with which the ring segments 120 may be removed for replacement of the impact head 16. If the bore diameter 121, 121' is sufficiently greater than the width 123 of the ring segments 120 and/or the edge 119 of the opening 84 is sufficiently close to the outer surface 79, 83, the arcuate shape of the ring segments 120 will allow the leading face 126 to pivot around the edge 119 of the opening 84 as the ring segment 120 is positioned over the opening 84. In this first embodiment, the length 124 of the ring segments 120 may be greater than the length 122 of the opening 84. If the bore diameter 121, 121' is only slightly greater than the width 123 of the ring segments and/or the edge 119 of the opening 84 is far from the outer surface 79, 83, the leading face 126 will not be able to pivot around the edge 119 of the opening 84. In this second embodiment, the length 124 of each ring segment 120 must be smaller than the length 122 of the opening. It is relatively easier to remove the ring segments 120 of the second embodiment since the ring segments 120 need not pivot during the removal operation.

The leading face 126 of each subsequent ring segment 120 engages the trailing face 128 of the prior ring segment 120, allowing the subsequent ring segments 120 to push the prior ring segments 120 around the channel 112, 114. The ring segments 120 are retained within each channel 112, 114 by a pin 130, preferably composed of delrin, which is inserted into the corresponding bore 80, 82, thereby plugging the opening 84. In a preferred embodiment, the pins 130 include endcaps 132 which have detents 134 that engage small undercuts 136 in the bore 80, 82, to retain the pin 130 in the bore 80, 82. An O-ring 138 may be disposed in a circumferential groove 140 in the endcaps 132 to prevent dirt, cuttings and pneumatic fluid from entering the channels 112, 114.

In a preferred embodiment, the four ring segments 120 define retaining members 116 and occupy an arc 146 of the circular channels 112, 114 of approximately 280°. The ring segments 120 engage the upper and lower surfaces 142, 144, 142', 144' of the grooves 76, 78, 106, 108 forming the channels 112, 114 to retain the impact head 16 to the guide member 14. Simultaneous engagement of the retaining member 116 to the impact head 16 and guide member 14 along an extended arc 146 allows the stress imposed on the retaining member 116 and the upper and lower surfaces 142, 144 to be spread out, reducing the possibility of failure. The ring segments 120 have a substantially square cross-sectional area, providing substantial surface contact with the upper and lower surfaces 142, 144, 142', 144' and greater mechanical strength.

It should be appreciated that engagement of the retaining member 116 to the impact head 16 and guide member 14 along a smaller arc will also spread out the stress, reducing the possibility of failure relative to conventional drill bits. Consequently, grooves 76, 78 and/or grooves 106, 108 may be formed such that they do not extend completely circumferentially around the wall 74 of the receptacle 62 or the outer surface 104 of the mounting portion 64 with a corresponding reduction of the engagement surface areas. The retaining member 116 should occupy an arc 146 of engagement with the channels 112, 114 of at least 180° to sufficiently spread the stress. It should be further appreciated that the ring segments 120 and delrin pins 130 are easily and quickly installed to mount the impact head 16 to the guide member 14. The ring segments 120 are relatively inexpensive to manufacture and the drill bit 10 does not require a threaded connection, which is produced by a relatively expensive manufacturing process, to retain the impact head 16 to the guide member 14.

Figure 9:
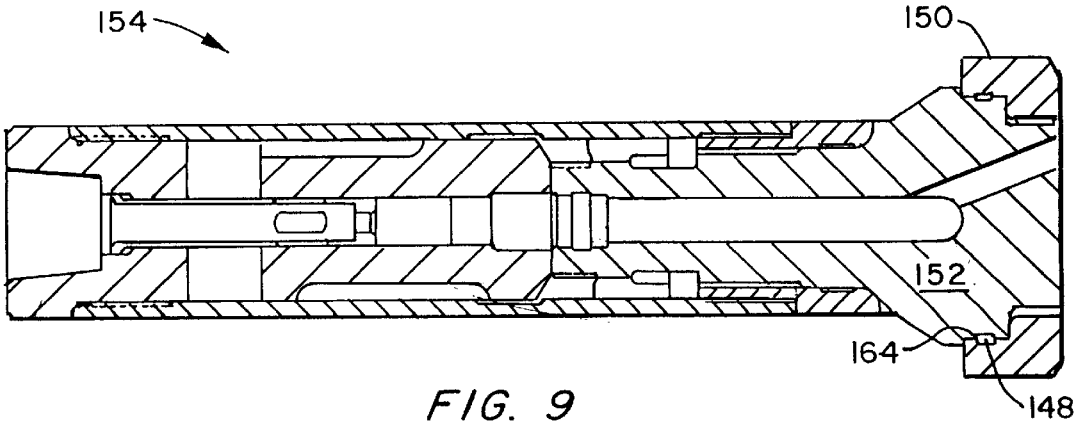
FIG. 9 is longitudinal section view of a second embodiment of a drill bit in accordance with the present invention.
Figure 10:
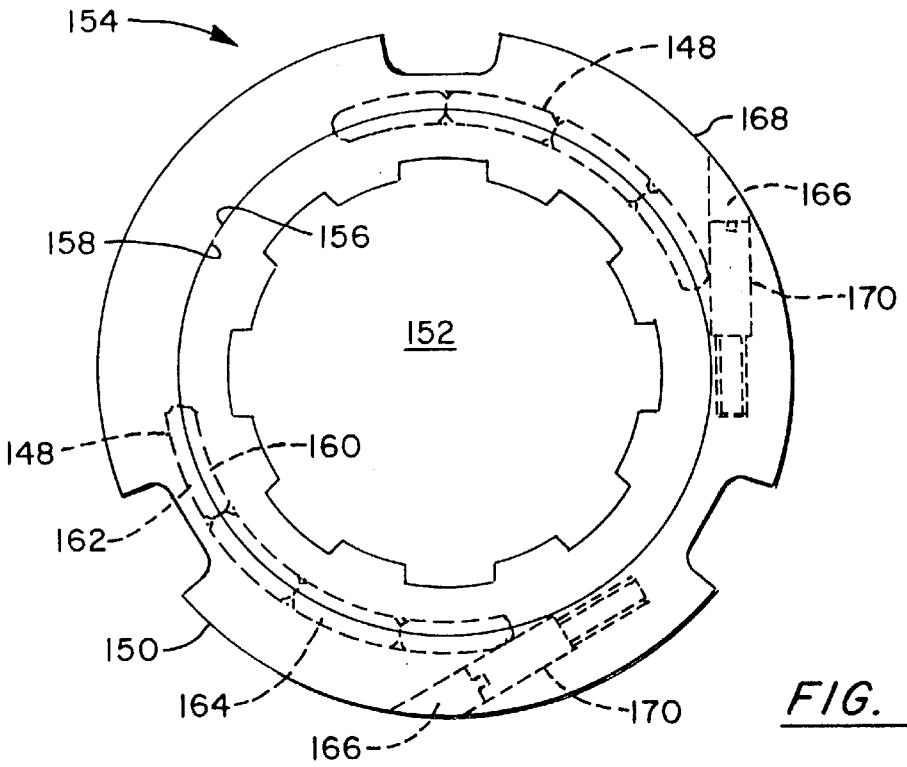
FIG. 10 is an enlarged bottom view, partly in phantom, of the drill bit of FIG. 9.

With reference to FIGS. 9 and 10, a plurality of retaining ring segments 148 mount a replaceable ring head 150 to the guide member 152 of a second embodiment 154 of the drill bit. The outside surface 156 of the guide member 152 and the inside surface 158 of the ring head 150 may each include a circumferential groove, forming a circumferential channel for receiving the retaining ring segments as shown in FIGS. 1–4 of the first embodiment. Alternatively, the outside surface 156 of the guide member 152 and the inside surface 158 of the ring head 150 may each include one or more corresponding groove sections 160, 162, respectively, forming channel sections 164 for receiving the retaining ring segments 148 (FIG. 10). A bore 166 extending from the outer surface 168 of the ring head 150 to each ring head groove section 162 provides a path for inserting the ring segments 148 into the channel sections 164. A pin 170 mounted in each bore 166 retains the ring segments 148 in the channel sections 164. The use of multiple channel sections 164 facilitates installation of the retaining ring segments 148 but reduces the total engagement surface area between the retaining ring segments 148 and the upper and lower surfaces of the channel sections 164.

Figure 11:
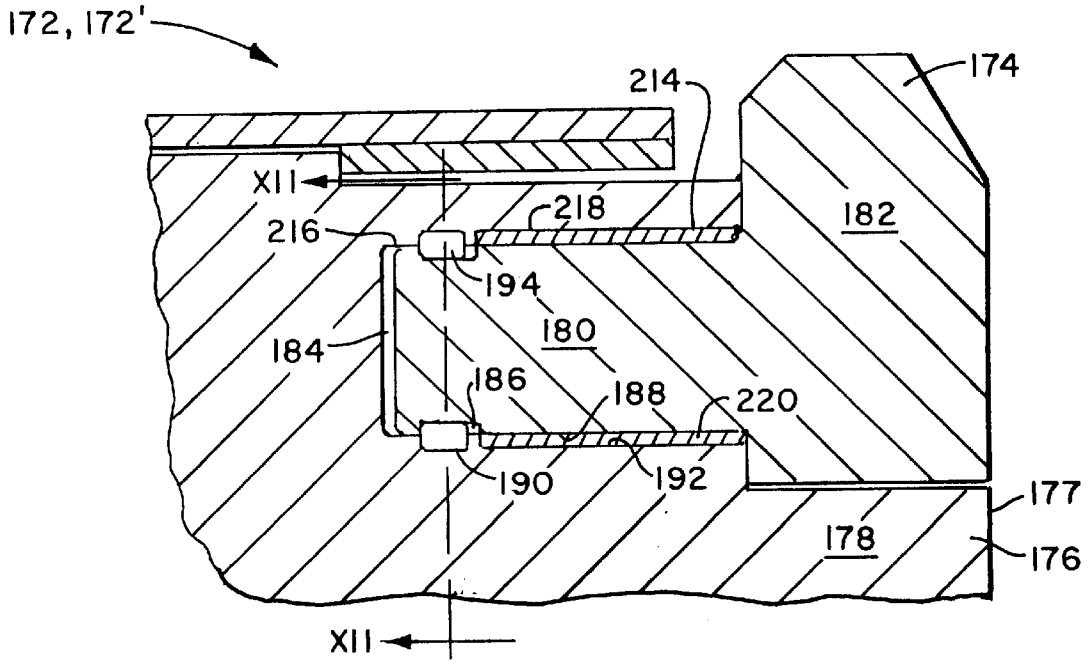
FIG. 11 is a partial longitudinal section view of a third embodiment of a drill bit in accordance with the present invention.
Figure 12:
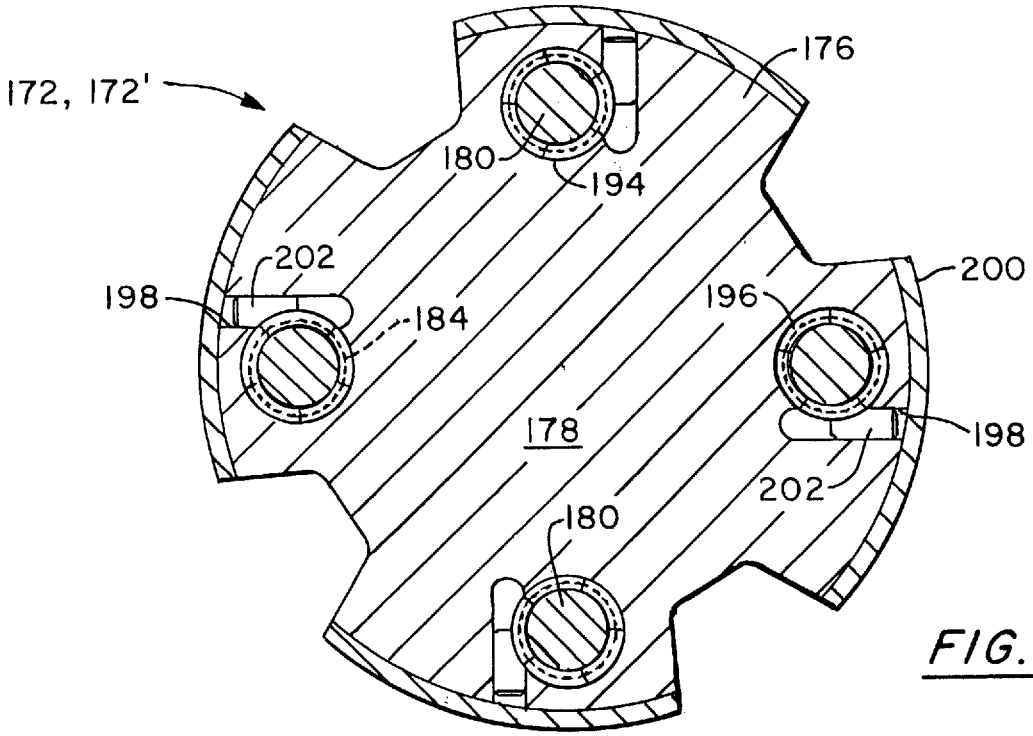
FIG. 12 is an enlarged section view taken along line XII—XII of FIG. 11.
Figure 13:
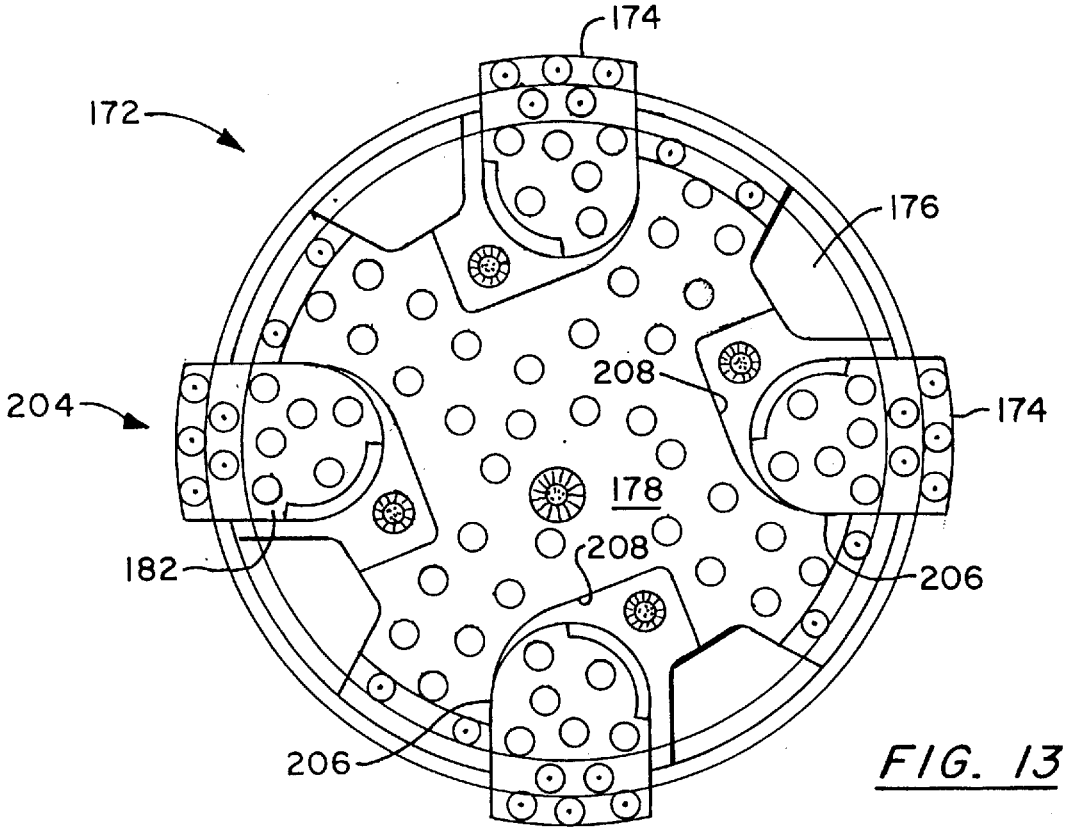
FIG. 13 is a bottom view of the drill bit of FIG. 11 illustrating the impact heads in the extended position.
Figure 14:
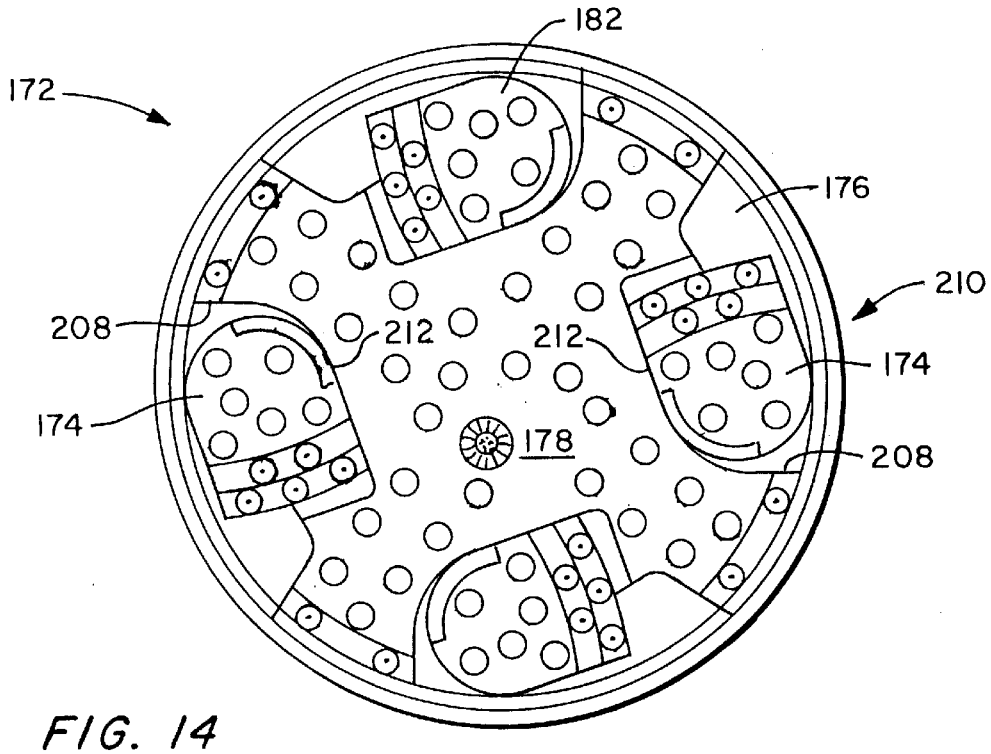
FIG. 14 is a bottom view of the drill bit of FIG. 11 illustrating the impact heads in the retracted position.
Figure 15:
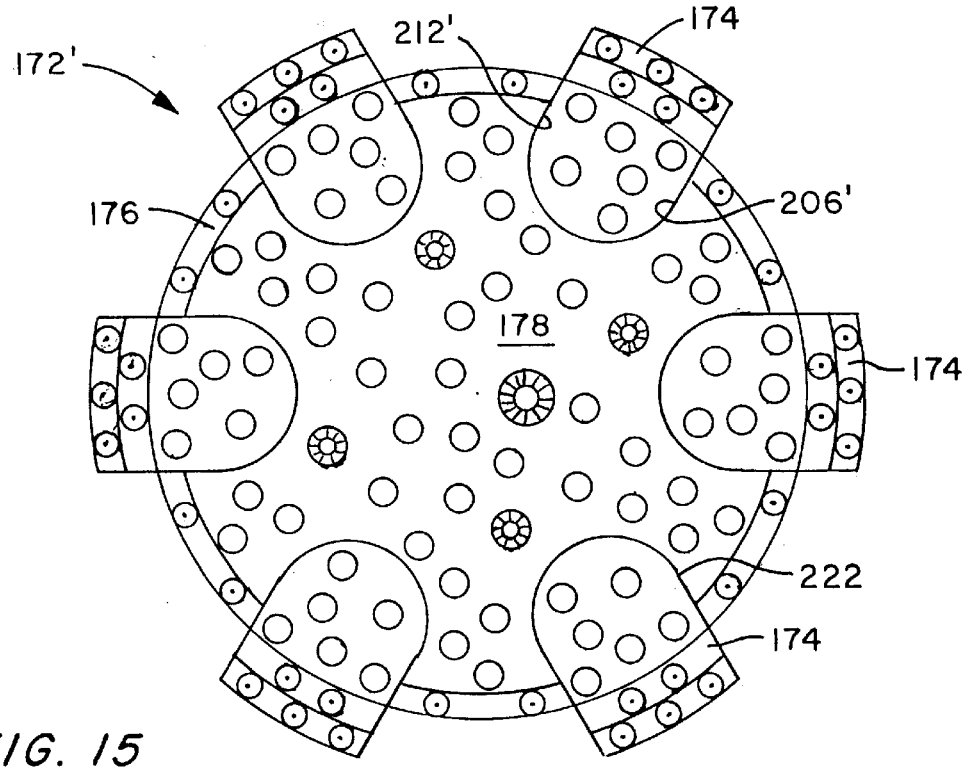
FIG. 15 is a bottom view of an alternate embodiment of the drill bit of FIG. 11.

The transverse loads generated during rotation of a drill bit 10 in accordance with the first embodiment effectively limit the use of such drill bits 10 to holes having a maximum diameter of approximately twelve (12) inches. The bit retention system shown in FIGS. 11 and 12 is utilized for drilling holes having a diameter greater than twelve inches. With further reference to FIGS. 13–15, drill bit 172, 172' has a plurality of impact heads 174 that are distributed uniformly on the periphery 176 of the bottom face 177 of the guide member 178 such that the transverse loads generated by the impact heads 174 cancel each other.

An axially extending retention shaft 180 extending upward from the body 182 of each impact head 174 is received in an axially extending opening 184 in the face 177 of the guide member 178. A circumferential groove 186 in the outer surface 188 of the retention shaft 180 is positioned adjacent a circumferential groove 190 in the inner surface 192 of the opening 184 to form a circumferential channel 194. Retaining ring segments 196 are inserted into each channel 194 via a bore 198 which extends from the outer surface 200 of the guide member 178 to each groove 190 to mount the impact heads 174 to the guide member 178. A pin 202 positioned in each bore 198 retains the retaining ring segments 196 in the channels 194. The diameter of the lower portion 214 of the opening 184 is greater than the diameter of the upper portion 216 of the opening 184, providing a receptacle 218 for receiving a hardened steel bushing 220.

In the drill bit of FIGS. 13 and 14, the retention shafts 180 are free to pivot within the openings 184. When the drill bit 172 is rotated in the drilling direction, the impact heads 174 pivot to an extended position 204 and are held in the extended position 204 against the rotation of the drill bit 172 by engagement between the first side 206 of the impact head 174 and a shoulder 208 of the guide member 178 (FIG. 13). When the drill bit 172 is rotated in the opposite direction, the impact heads 1 74 pivot to a retracted position 210 and are held in the retracted position 210 against the rotation of the drill bit 172 by engagement between the second side 212 of the impact head 174 and the shoulder 208 of the guide member 178 (FIG. 14). Such a drill bit 172 is utilized with overburden drills where the drill bit 172 produces a hole large enough to accept the drill casing 44 but may be withdrawn back through the drill casing 44.

In the drill bit 172' shown in FIG. 15, the bit retention system shown in FIGS. 11 and 12 is utilized to fixedly mount the impact heads 174 to the guide member 178 in a secure manner that facilitates replacement of the impact heads 174. The first and second sides 206', 212' of the impact heads 174 engage the shoulder 222 of the guide member 178 to prevent relative rotation between the impact heads 174 and the guide member 178.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A downhole hammer bit comprising:

an elongated guide member having a surface defining groove means comprising at least one groove;

at least one impact head having a surface disposed adjacent said surface of said guide member, said surface of said impact head defining groove means comprising a groove disposed oppositely said groove of said guide member, wherein said groove of said guide member and said groove of said impact head define a channel;

an exterior surface and bore means comprising and at least one bore extending from said exterior surface, said bore intersecting said channel to define an opening into said channel; and retainer means comprising at least one retainer member comprising a plurality of retaining ring segments, each of said retaining ring segments being positionable in said channel through said bore and said opening for retaining said impact head to said guide member.

2. The downhole hammer bit of claim 1 wherein said guide member comprises a longitudinally extending skirt, said skirt having inner and outer surfaces and defining a receptacle, said inner surface defining said groove means of said guide member, said bore means extending from said outer surface inwardly toward said channel, said impact head having a mounting portion disposed within said receptacle, said mounting portion having an outer surface defining said groove means of said impact head.

3. The downhole hammer bit of claim 2 wherein said groove means of said skirt comprises first and second longitudinally spaced grooves, said groove means of said mounting portion defines first and second longitudinally spaced grooves, and said retainer means comprises first and second retainer members, said first and second grooves of said skirt being disposed oppositely said first and second grooves of said mounting portion, respectively, defining first and second channels, and said first and second retainer members being disposed in said first and second channels, respectively.

4. The downhole hammer bit of claim 2 wherein said bore of said skirt extends from a first position on said outer surface to a second position on said outer surface.

5. The downhole hammer bit of claim 2 wherein said guide member further has an impact head mounting segment forming said skirt and a drive shank extending longitudinally from said impact head mounting segment to an anvil end face, said impact head further has at least one operating face, said impact head mounting segment defines a passage extending longitudinally from said receptacle, said drive shank defines a passage extending longitudinally from said passage of said impact head mounting segment to said anvil end face, and said mounting portion of said impact head defines a longitudinally extending fluid outlet plenum disposed oppositely said passage of said impact head mounting segment and at least one longitudinally and laterally extending distribution passage having a first end in fluid communication with said outlet plenum and a second end disposed in said operating face.

6. The downhole hammer bit of claim 2, wherein said mounting portion defines a circumferential notch and said downhole hammer bit further comprises a first O-ring disposed in said notch for sealing said mounting portion to said skirt.

7. The downhole hammer bit of claim 2 further comprising at least one pin, said pin being positionable in said bore of said skirt for retaining said retainer member in said channel.

8. The downhole hammer bit of claim 7 wherein said pin comprises oppositely disposed first and second end portions, each of said end portions defining a circumferential groove, and said pin further comprises a second and third O-rings disposed in said grooves of said first and second end portions, respectively, for sealing said pin to said bore.

9. The downhole hammer bit of claim 2 wherein each retainer member comprises four ring segments, each of said ring segments having a leading face and a trailing face.

10. The downhole hammer bit of claim 9 wherein each retainer member occupies an arc of said circular channel of substantially 280°.

11. The downhole hammer bit of claim 9 further comprising at least one pin disposed in said bore, said pin confronting a leading face of one ring segment and a trailing face of another ring segment to retain said retainer member in said channel.

12. The downhole hammer bit of claim 2 wherein said opening defined by said bore and said groove has a length and each of said ring segments has a length, said length of said opening being greater than said length of each of said ring segments.

13. The downhole hammer bit of claim 2 wherein said guide member defines an axis, said skirt of said guide member comprises longitudinally spaced first and second end faces defining first and second shoulders, said impact head defines a centerline which is radially offset from said axis, and said impact head comprises a leading, pilot impact bit and a trailing, impact bit sector having longitudinally spaced end faces defining first and second shoulders, said impact head being rotatable about said centerline between an extended position and a retracted position, said first and second shoulders of said impact head being engageable with a corresponding shoulder of said guide member to hold said impact head in either said extended position or said retracted position.

14. The downhole hammer bit of claim 1 wherein said guide member comprises a mounting portion having an outer surface defining said groove means of said guide member and said impact head comprises a ring having inner and outer surfaces, said inner surface defining said groove means of said impact head, said bore means extending radially from said outer surface to said channel.

15. The downhole hammer bit of claim 14 wherein said groove means of said guide member and said groove means of said impact head each comprise a plurality of groove sections, said groove sections of said guide member being disposed oppositely said groove sections of said impact head to define a plurality of channel sections and said bore means comprises a plurality of bores, wherein at least one bore extends from said outer surface of said impact head to each of said channel sections.

16. The downhole hammer bit of claim 1 wherein said downhole hammer bit comprises a plurality of impact heads, each of said impact heads having an axially extending retention shaft having an outer surface defining a said groove means of said impact head, said guide member comprises an outer surface and a face having a peripheral portion defining a plurality of axially extending openings for receiving a retention shaft of a said impact head, each of said openings having a surface defining a said groove means of said guide member, and said bore means extends radially from said outer surface to said channel.

17. The downhole hammer bit of claim 16 wherein said hammer bit defines an axis, said face of said guide member comprises a plurality of shoulders, a said shoulders being disposed adjacent each of said openings, each of said impact heads comprises first and second sides, and each of said retention shafts is pivotally mounted in a said opening between an extended position and a retracted position, said first and second sides of said impact heads being engageable with a corresponding shoulder of said guide member to hold said impact head in either said extended position or said retracted position.

18. The downhole hammer bit of claim 16 further comprising a bushing disposed intermediate at least a part of each said retention shaft and said surface of said opening.

19. The downhole hammer bit of claim 16 wherein said face of said guide member comprises a plurality of shoulders, a said shoulders being disposed adjacent each of said openings and each of said impact heads comprises first and second sides, said first and second sides of said impact heads being engageable with a corresponding shoulder of said guide member to fixedly mount said impact head to said guide member.

20. A downhole hammer bit comprising:

an elongated guide member having a vertically extending axis and a downwardly extending skirt, said skirt having inner and outer surfaces and defining a receptacle and upper and lower bores extending from said outer surface, said inner surface defining upper and lower circumferential grooves, said upper and lower bores intersecting said upper and lower grooves, respectively, to define upper and lower openings into said receptacle;

an impact head having a mounting portion disposed within said receptacle, said mounting portion having an outer surface defining upper and lower grooves disposed oppositely said upper and lower grooves of said skirt, respectively, wherein said upper and lower grooves of said skirt and said upper and lower grooves of said mounting portion define upper and lower circular channels;

upper and lower retainer members, each of said retainer members comprising a plurality of retaining ring segments, each of said retaining ring segments being positionable in a said channel through said bore and said opening for retaining said impact head to said guide member; and upper and lower pins disposed in said upper and lower bores of said skirt for retaining said retainer members in said upper and lower channels.

21. The downhole hammer bit of claim 20, wherein outer surface of said mounting portion further defines a circumferential notch disposed below said lower groove and said downhole hammer bit further comprises a first O-ring disposed in said notch for sealing said mounting portion to said skirt.

22. The downhole hammer bit of claim 20 wherein each of said pins comprises oppositely disposed first and second end portions, each of said end portions defining a circumferential groove, and said hammer bit further comprises a pair of O-rings disposed in said grooves of said first and second end portions, respectively, for sealing said pin to said bore.

23. The downhole hammer bit of claim 20 wherein each retainer member occupies an arc of said circular channel of substantially 280°.

24. The downhole hammer bit of claim 20 wherein said skirt of said guide member comprises upper and lower end faces defining first and second shoulders, said impact head defines a centerline which is radially offset from said axis, and said impact head comprises a lower, pilot impact bit and am upper, impact bit sector having longitudinally spaced upper end faces defining first and second shoulders, said impact head being rotatable about said centerline between an extended position and a retracted position, said first and second shoulders of said impact head being engageable with a corresponding shoulder of said guide member to hold said impact head in either said extended position or said retracted position.

25. An arrangement for securing a drilling component shank rotatably within a substantially tubular drilling component guide member in a downhole hammer bit assembly, comprising:

said guide member having an external surface and an internal surface with at least one internal, substantially annular groove;

said shank having a substantially cylindrical outer surface defining a substantially annular external groove disposed oppositely a respective internal groove of the guide member, wherein the grooves of the guide member and the grooves of the shank define respective substantially circular channels;

a respective bore penetrating the guide member exterior surface and intersecting each channel, thereby defining openings into the channels; and a plurality of retaining ring segments positionable in each channel through each bore and each opening, for retaining the shank to the guide member.

* * * * *